US006584823B2

(12) United States Patent
Hresc et al.

(10) Patent No.: US 6,584,823 B2
(45) Date of Patent: Jul. 1, 2003

(54) TWO WIRE SPRING MAKING MACHINE AND METHOD

(75) Inventors: Stjepan Hresc, Prelog (HR); Branko Duras, Varazdinske Toplice (HR)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 10/020,781

(22) Filed: Dec. 14, 2001

(65) Prior Publication Data

US 2002/0104353 A1 Aug. 8, 2002

Related U.S. Application Data

(63) Continuation-in-part of application No. 09/582,909, filed on Sep. 18, 2000, now Pat. No. 6,374,655.

(51) Int. Cl.[7] ..... B21F 11/00; B21F 3/02

(52) U.S. Cl. ..... 72/129; 72/135; 72/140; 72/142; 140/3 CA

(58) Field of Search ..... 72/129, 135, 140, 72/142; 242/474.3; 140/3 CA, 92.3, 92.4, 92.7, 92.8; 29/605

(56) References Cited

U.S. PATENT DOCUMENTS 4,111,241 A 9/1978 Crown ..... 140/92.7
4,548,365 A * 10/1985 Marzec et al. ..... 29/605
5,131,251 A * 7/1992 Jacobson ..... 72/140
5,259,227 A 11/1993 Jacobson
5,274,907 A * 1/1994 Moorehead ..... 29/736
5,579,810 A 12/1996 Ramsey et al. ..... 140/3
5,782,273 A * 7/1998 Moser et al. ..... 140/92.4
5,887,471 A 3/1999 Itaya
5,934,339 A * 8/1999 Ramsey ..... 140/3 CA
5,950,473 A * 9/1999 Andrea et al. ..... 72/134
6,006,572 A 12/1999 Tsuritani
6,374,655 B1 4/2002 Hresc

* cited by examiner

*Primary Examiner*—Ed Tolan
(74) *Attorney, Agent, or Firm*—Wood, Herron & Evans, L.L.P.

(57) ABSTRACT

A method and machine for selectively manufacturing wire springs from two different wires by feeding the wires through a pair of continuously rotatable opposed feed rollers, which rollers are operative to feed only one of the wires at a time into engagement with a coil forming mechanism having a pair of coil forming tools. The tools are selectively positionable for engagement with one or the other of the two wires depending upon which of the two wires is being fed into the coil forming mechanism.

14 Claims, 3 Drawing Sheets

TWO WIRE SPRING MAKING MACHINE AND METHOD

This application is a Continuation-in-Part application of application Ser. No. 09/582,909, now U.S. Pat. No. 6,374,655 filed Sep. 18, 2000, and entitled "Spring Winding Automatic Machine". This invention relates to the manufacture of springs and, more particularly, to the manufacture of coil springs for use in mattresses and furniture.

BACKGROUND OF THE INVENTION

It is common practice in the mattress and furniture industry for bedding springs to be manufactured on a so-called coiler and fed directly from that coiler into an assembly machine whereat the springs are assembled into rows and columns and joined together to create a mattress spring core. Such a machine is described, for example, in U.S. Pat. Nos. 4,492,298 and 4,111,241.

Recently, mattresses have been designed which utilize multiple differing springs of differing firmness throughout the spring core. In some cases, springs of one firmness are used on one side of a mattress, and springs of a different firmness on the other side to accommodate two persons who prefer mattresses of differing firmness. Such a mattress is illustrated and described, for example, in U.S. Pat. No. 5,987,678. In other cases, springs of differing firmness are located around the edge of a mattress to impart a firm edge to the mattress. And, in still other cases, springs of differing firmness are located in differing longitudinal sections of the mattress to vary the firmness over the length of the mattress. These later varying firmness mattresses are identified as so-called "posturized" mattresses. Such a posturized mattresses is described, for example, in U.S. Pat. No. 5,868,383.

The advent of these multiple spring mattresses has given rise to the need for machinery for manufacturing those springs of differing firmness and supplying them to an assembly machine in a predetermined order or sequence. To that end, mattress making machinery has been created which utilizes two coilers to supply two different springs to a single assembly machine in a prescribed sequence. This requires, though, that there be two coilers and a complex transport system, as well as a complex control system, for feeding springs from the two different coilers in a prescribed sequence to the mattress spring core assembly machine. Such a machine is illustrated and described, for example, in U.S. Pat. No. 5,579,810.

The machines which have been heretofore available for supplying springs of differing firmnesses to an assembly machine in a prescribed sequence or order are very expensive and complex. It has therefore been an objective of this invention to provide a spring coiler which is less expensive and less complex than machines heretofore available for supplying springs of two differing firmnesses to an assembly machine in a prescribed sequence.

It has been another objective of this invention to provide a spring coiler which is capable of forming springs at high speeds from two different wires into coil springs capable of being fed directly into a spring assembly machine in a prescribed order.

SUMMARY OF THE INVENTION

The coiler of this invention is operative to selectively manufacture coil springs from two different wires, usually one of lighter gauge for making coil springs of relatively light firmness, and a second heavier gauge wire for making more firm coil springs. This machine comprises a pair of opposed feed rollers which are continuously rotatable without interruption in one feed direction during manufacture of coil springs from each of the two different wires and during the changeover from one wire to the other. From the opposed wire feed rollers, the two wires extend into a wire guide from whence the one or the other of the two wires is fed by the opposed feed rollers into a coil forming mechanism. That coil forming mechanism comprises a pair of coil forming tools and at least one pitch determining tool, which coil forming tools are selectively movable into alignment with one or the other of the two different wires, such that one coil forming tool is engageable with and operative to form one wire into the coil, and the other coil forming tool is engageable with and operative to form the other wire into a coil.

The method practiced according to the invention of this invention is operative to form coil springs of differing firmnesses from two different wires. This method comprises the steps of locating the two wires between opposed wire feed rollers, continuously rotating the opposed wire feed rollers without interruption in one wire feed direction, supporting the two wires upon a wire guide positioned adjacent the output side of the wire feed rollers, positioning a first coil forming tool in alignment with the first one of the two wires supported upon the wire guide, moving the rotating opposed feed rollers into driving engagement with a first one of the two wires so as to feed that first wire into engagement with the first coil forming tool, and into engagement with a pitch determining tool so as to create a helically formed coil spring at the end of the first wire, moving the rotating opposed feed rollers out of driving engagement with the first wire to terminate feed of the first wire between the feed rollers, cutting the helically formed coil spring from the end of the first wire, moving a second forming tool into alignment with the second of the two wires supported upon the wire guide, moving the rotating opposed feed rollers into driving engagement with the second wire so as to feed that second wire into engagement with the second coil forming tool and into engagement with a pitch determining tool so as to create a helically formed coil spring at the end of the second wire, moving the opposed feed rollers out of driving engagement with the second wire to terminate feed of that second wire between the opposed feed rollers, and cutting the helically formed coil spring from the end of the second wire.

The principal advantage of the invention of this application is that it provides a very high speed and relatively inexpensive machine for manufacturing coil springs of differing firmnesses from two different wires. Preferably, but not necessarily, the coil springs are of substantially the same dimension, but of differing firmness as a consequence of their having been manufactured from wires of differing diameter.

These and other objects and advantages of this invention will be more readily apparent from the following description of the drawings in which.

GENERAL ORGANIZATION OF COILER

Figure 1:
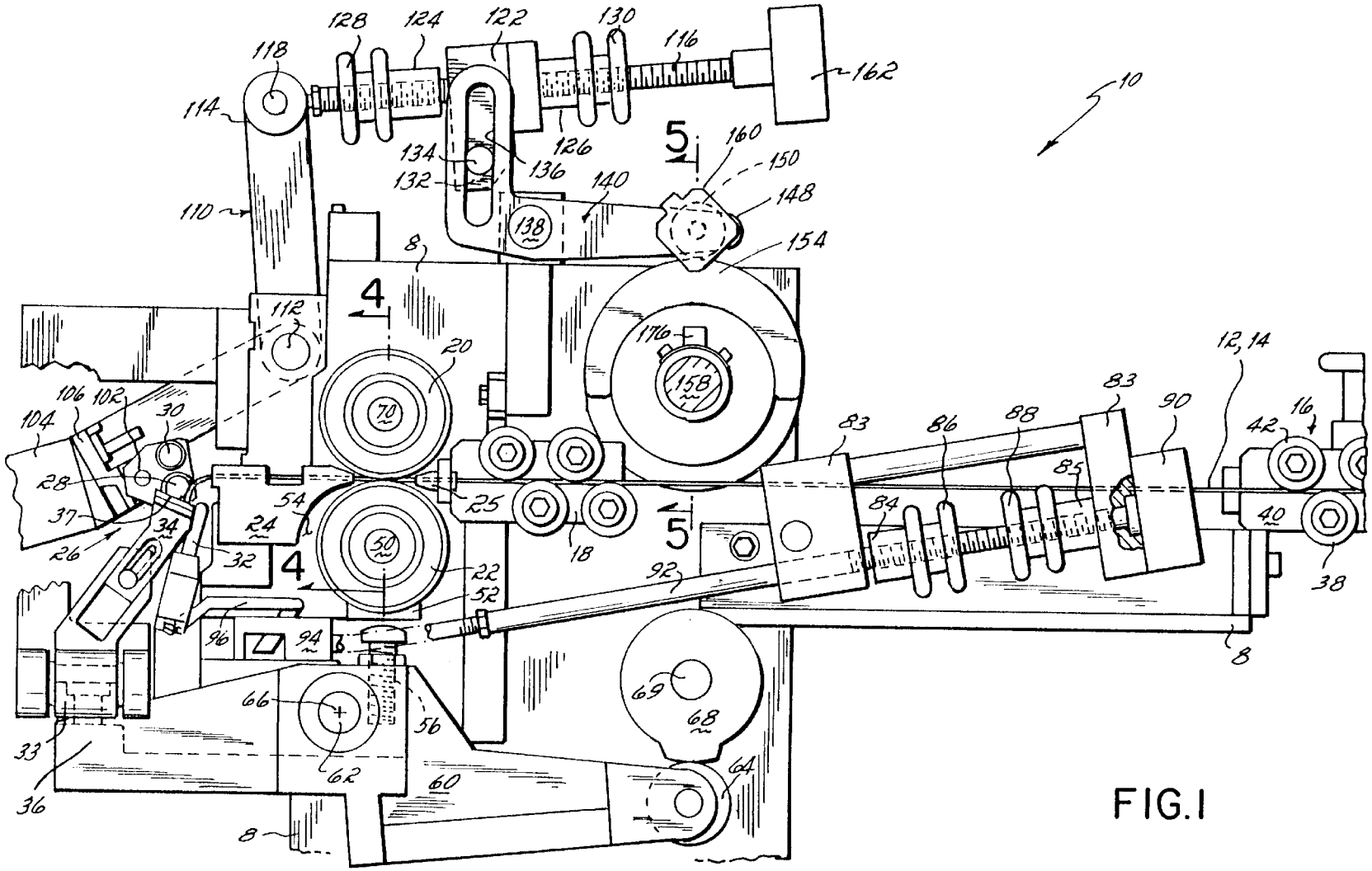
FIG. 1 is a partially schematic side elevational view of two wire spring making machines constructed in accordance with the principles of this invention, the cutter being shown in a cut-off position.

The coiler 10 of this invention is operative to form either one of two wires 12 and 14 into spring coils 12*c* and 14*c*, respectively. These wires 12 and 14 are preferably of differing diameter and are supplied to the coiler 10 from two separate wire supply reels (not shown).

The coiler 10 comprises a conventional wire straightener 16 operative to straighten the wire supplied from the supply reels to the machine as the wire is input into the machine. From the straightener 16, the wires are supplied to a wire guide 18 on the input side of a pair of opposed feed rollers 20, 22. On the output side of these opposed feed rollers 20, 22, there is a wire guide 24 operative to supply the wires and guide them into a wire forming station 26. At the forming station, one or the other of the two wires, depending upon which is selected, is engageable with one or the other of a pair of coil forming rollers 28, 30, and a pitch determining tool 32. After formation of a wire into a helically wound spring coil, as a result of contact of the wire with one or the other of the forming rolls 28, 30, and the pitch determining tool 32, a cut-off tool 34 is operative to cut the helically formed spring from the end of the wire.

Wire Straightener

The wire straightener 16 is a conventional wire straightener fixedly mounted upon the base 8 of the coiler. It comprises a series of lower rollers 38 rotatingly mounted upon the base 40 of the straightener and an upper series of rollers 42 adjustably mounted for movement toward and away from the lower set of rollers. Both sets of rollers are provided with peripheral channels or grooves through which the two wires 12 and 14 pass. In the course of passage through the straightener and through the channels of the two sets of rollers 38, 42, the wire is worked and straightened in a manner well known in the art.

Input Guide to Feed Rollers

Also stationarily mounted upon the base 8 of the coiler is the wire input guide 18. This guide also comprises a series of rollers having channels or peripheral grooves operative to guide the wires 12 and 14 to and through an input guide 25 from whence the wires are supplied to the feed rollers 20, 22.

Feed Rollers

Figure 4:
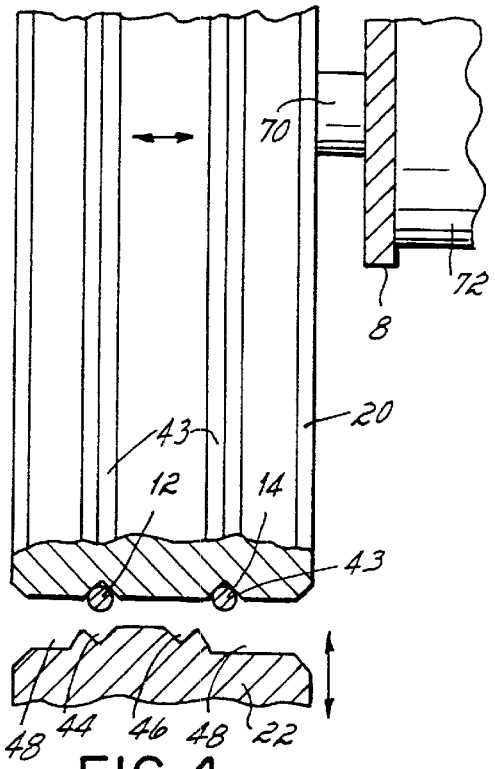
FIGS. 4 and 4A are cross sectional views taken along line 4—4 of FIG. 1 showing the two positions of the feed and pressure rolls.
Figure 4A:
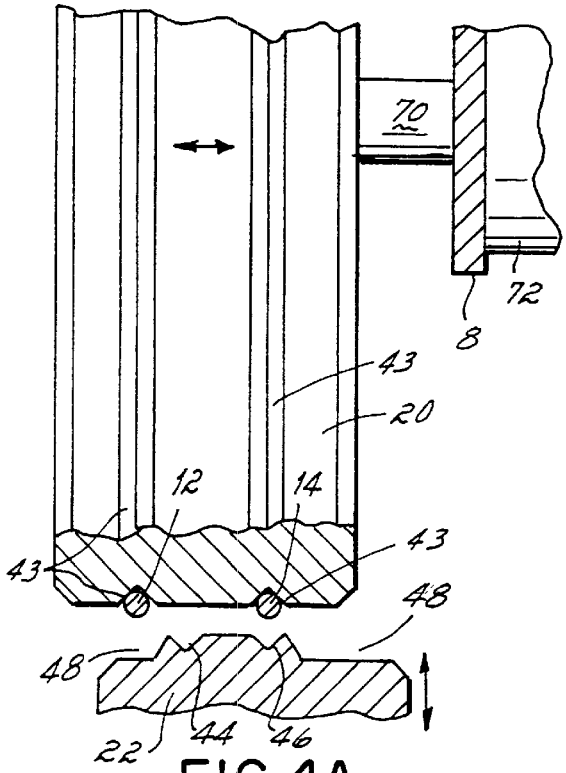

As may best be seen in FIGS. 4 and 4A, the opposed feed rollers 20, 22 each have peripheral grooves formed therein through which the wires 12 and 14 pass in the course of passage to the wire guide 24. The upper roll 20 has a pair of shallow grooves 43. In addition to two relatively shallow feed grooves 44, 46 through which the wires pass, there are a pair of deeper resting grooves 48 in roller 22 within which the wires are located when not being fed through the feed rollers to the forming tools. In practice, one wire is located in a shallow groove whenever the other wire is located in a deeper groove, such that only one wire is fed at a time to the forming tools. In order to reposition the wires relative to the grooves, the lower roller 22 is mounted for vertical movement relative to the upper roller, and the upper roller 20 is mounted for axial movement relative to the lower roller. When the lower roller 22 is in its raised position, the rollers are operative to feed or drive one or the other of the two wires 12, 14 to the forming tools and, when the lower roller is in its lower position, the feed of both wires is terminated. In this lowered position of the lower roll, the upper roller 20 may be moved between one of its two positions so as to position the other or second wire in a shallow groove, and the first wire in a deeper groove, such that the second wire will be fed to the forming station 26 upon raising of the roller roll while the first wire is left in a deeper groove whereat it will not be fed to the forming station by rotation of the opposed rollers.

It should be appreciated that at all times when the coiler machine 10 is in operation, the feed rollers 20 and 22 continue to rotate in a direction to feed the wires 12 and 14 to the forming station. Neither of these rollers stops its rotation even when the lower feed roller is in its lowered position and a wire is not being fed to the forming station. Both the feed rollers continue to rotate in the same direction, but with the lower feed roll in its lower position, neither of the wires is fed to the forming station, and both wires are stationary. Only when the lower roll is raised does one or the other of the two wires become pinched between the feed rolls and move toward the forming station.

In order to effect vertical movement of the lower feed roller 22, it is drivingly mounted upon a supporting shaft 50 which is in turn journaled in a vertically movable block 52. This block is slidably mounted in a fixedly mounted supporting plate 54, which is in turn fixedly supported from the base 8 of the machine. The slidable block 52 is elevated into feed position by a pin 56 threaded into a bore of a rocker arm 60. This rocker arm is journaled for pivotal movement on a shaft 62, which is in turn supported from the base 8 of the machine. The rocker arm has at one end a cam follower roller 64 engaged with a rotatable cam 68, such that rotation of the cam 68 causes the cam follower 64 and, thus the rocker arm 60, to move up and down. The pin 56 which elevates the lower roller 22 is offset from the axis of rotation 66 of the rocker arm, such that this vertical movement of the rocker arm 60 causes corresponding vertical movement of the lower roller 22. Mounted on the opposite side of the rocker arm 60 from the cam follower 64 is the knife 34. Consequently, movement of the rocker arm affected by the cam 68 not only moves the lower feed roller 22 vertically, but also affects pivotal cutting movement of the cut-off knife 34.

The upper feed roller 20 is mounted for axial movement relative to the lower roller 22, and the base plates from which the rollers are supported. To that end, the roller 20 is supported upon a driven shaft 70, which is in turn movable between two positions by a pneumatic motor 72 (FIGS. 4 and 4A). This motor is operative whenever there is a changeover from one wire to the other to move the roller 20 and its supporting shaft 70 axially between one of two positions. In one position (FIG. 4), the opposed rollers are operative to drive one wire 12, and in the other position (FIG. 4A), to drive the other wire 14. In the course of movement between the two positions, the upper feed roll causes one wire to be moved from a shallow groove 44, 46 of the feed roll 22 to a deep groove 48 and the other wire to be moved from a deep groove 48 to a shallow groove 44, 46. In the one position in which the wire 12 is being driven, the wire 14 is located in a deeper groove, such that when the two rolls move together to pinch the first wire 12, the second wire 14 will not be pinched and will not be driven. In the other position of the upper roller 20, the second wire 14 is located beneath a shallow groove, and the first wire 12 is located beneath a deep groove, such that upon movement of the two rolls together, the second wire 14 is driven, and the first wire 12 remains stationary.

Forming Station

Figure 3:
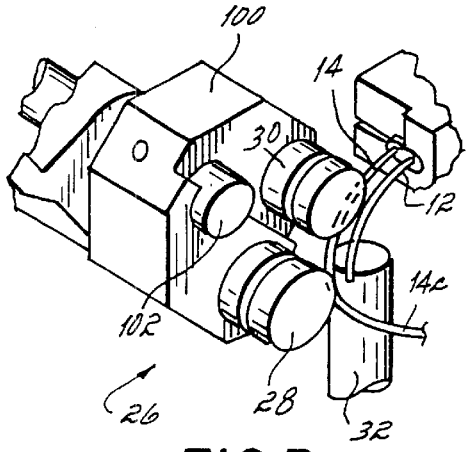
FIG. 3 is an enlarged partially schematic perspective of the forming rolls, the rolls being shown in their second position.
Figure 2:
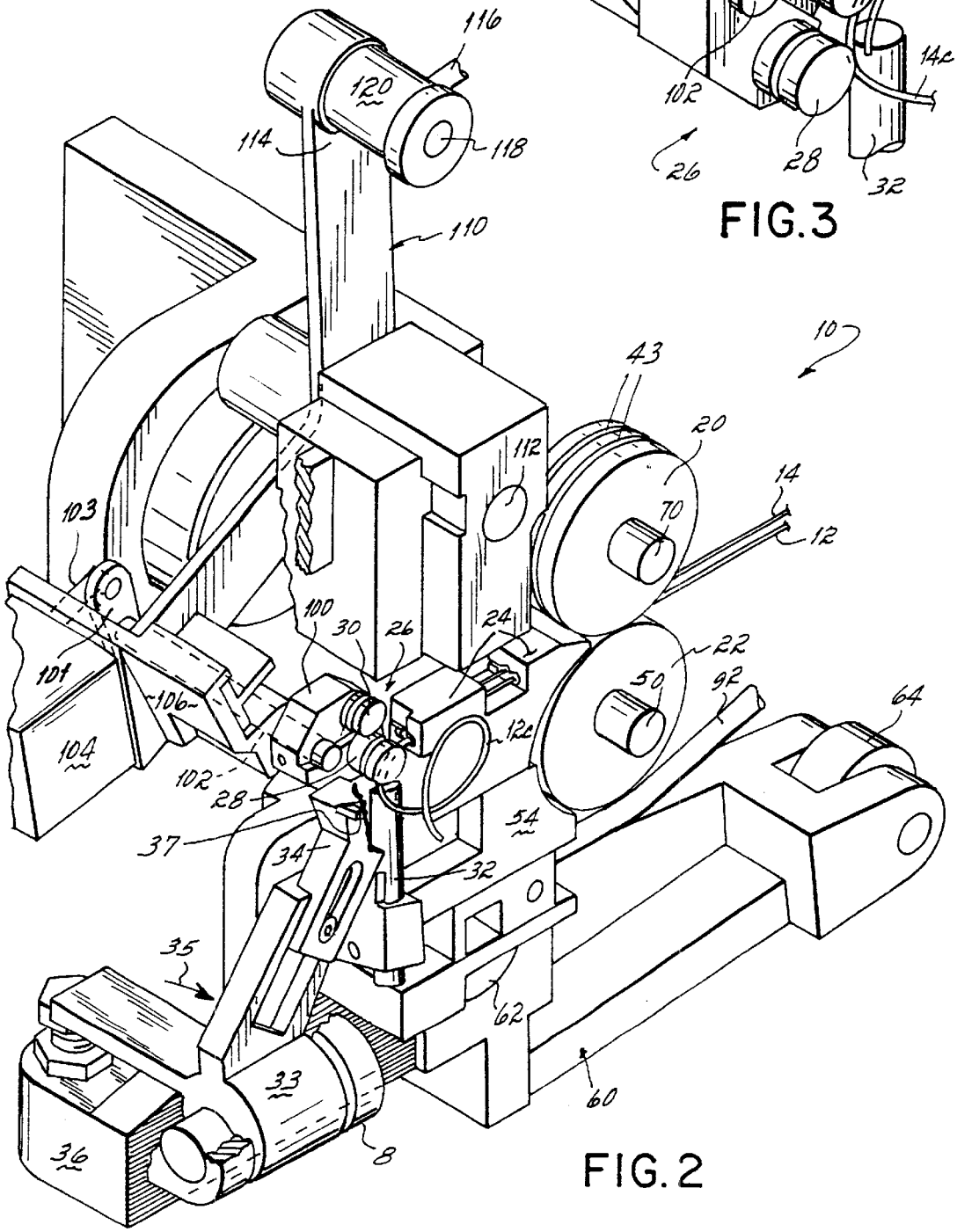
FIG. 2 is a partially schematic perspective view of a portion of the machine of FIG. 1, the cutter being broken away for clarity and showing the forming rolls in a first position.

With reference to FIGS. 2 and 3, it will be seen that two forming rollers 28, 30 are rotatably mounted upon a supporting block 100. This block 100 is in turn keyed to a supporting shaft 102, such that rotation of the shaft affects rotation of the block 100 between two positions. In one of these positions, the forming roller 28 is aligned with the wire 12 supported by the guide block 24, and in the other position to which the block 100 is movable, the forming roller 30 is aligned with the wire 12 supported on the guide block 24. The position in which the forming roller 28 is aligned with the wire 12 is illustrated in FIG. 2, and the position of the block 100 in which the forming roller 30 is aligned with the wire 14 is illustrated in FIG. 3.

In order to move the shaft 102, and thus the block 100 keyed thereto between the two positions to which it is movable, the shaft 102 is mechanically linked by a lever arm 101 arrangement or other conventional linkage connection to a piston rod 103 of a pneumatic cylinder 104. This cylinder is mounted upon a supporting plate 106 through which the shaft 102 extends to connection with the linkage from the cylinder 104. In one position of the pneumatic piston contained within the cylinder 104, the forming roll 28 is aligned with the wire 12, and in the other position of the cylinder, the forming tool 30 is aligned with the wire 14 at the point at which those wires extend from the guide block 24.

Coil Pitch Control

In the formation of coil springs from the two different wires 12, 14, the pitch control tool 32 must generally be moved between two different positions even though the resulting coil springs made from the two different wires may be of the same exact length and diameter dimensions. Even if the coil springs made from the two wires are to be of the same dimensions, because wires of differing diameter have differing physical characteristics, the tool to create the same pitch spring from those two different wires must be changed in position. In order to accommodate that change of position of the pitch control tool 32 between two positions, a pneumatic cylinder 90 is operable to move a piston rod 92 between two positions. Those two positions cause a control block 94 secured to the end of the piston rod 92 to be moved between two positions, and through an appropriate linkage 96 between the block 94 and the pitch control tool 32 to move the pitch control 32 between two positions.

The pneumatic cylinder 90 is mounted upon a U-shaped supporting block 83 through which the piston rod 92 is slidable. Threadedly mounted upon that piston rod are two stops 84, 85 which control the length of movement of the piston rod by the cylinder 90 between its two positions. The stops 84, 85 are in turn locked in position by lock nuts 86, 88 respectively, also threaded onto the piston rod. The operation of the cylinder 90 is such that when the feed rolls 20, 22 are operative to feed the wire 12 into the forming station, the pitch tool is positioned so as to apply an appropriate pitch to the coil formed from that wire, and when the feed rolls 20, 22 are positioned so as to feed the wire 14 into the forming station, the pitch control tool 32 is in the second or different position to apply an appropriate pitch to the coil formed by that wire.

Diameter Control of Spring Coil

Many springs as, for example, barrel-shaped springs or hourglass-shaped springs, require a change of diameter of the coils throughout the length of the coil spring. To that end, the coil forming tool mounting block 100 and the plate upon which it is mounted is movable or adjustable during the course of manufacture of a single coil spring so as to vary the diameter of the spring throughout its length. To that end, the coil forming tool mounting block 100 is supported upon the plate 106 which is in turn mounted upon a rocker arm 110. This rocker arm is pivotable about a supporting shaft 112 such that movement of the upper arm 114 of this rocker arm 110 produces a corresponding arcuate movement of the plate 106 and of the coil forming tools 28, 30 supported from that plate.

To effect movement of that rocker arm, the upper end of that rocker arm has one end of a control shaft 116 journaled thereon. This journal comprises a central shaft 118 fixedly attached to the upper end of the arm 114 upon which the end 120 of the control shaft 116 is rotatably journaled.

The control shaft 116 extends through and is slidable within a bore of a control block 122. The extent to which the control shaft may slide relative to this control block 122 is limited by a pair of stops 124, 126 threadedly mounted on the shaft 116 on opposite sides of the block. These stops 124, 126 each have a lock nut 128, 130, respectively, associated therewith so as to enable the stops to be locked in an adjusted position on the control shaft 116.

Fixedly mounted upon a depending arm 132 of the control block 122 is a cam follower 134. This cam follower is vertically slidable within a vertical slot 136 of a cam-controlled rocker arm 140. This rocker arm is rotatably supported upon a shaft 138, which is in turn supported from a plate fixed to the base 8 of the machine.

Figure 5:
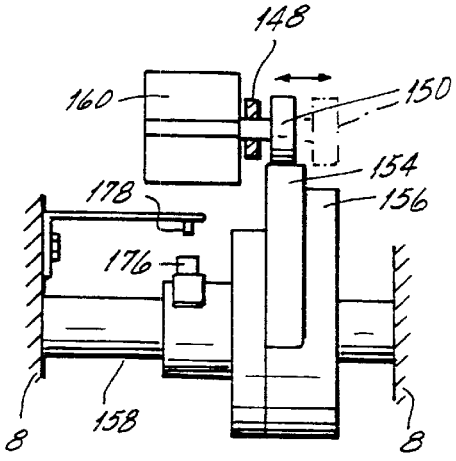
FIG. 5 is a cross sectional view taken along line 5—5 of FIG. 1.

To control movement of the rocker arm 140 relative to the shaft 138, there is a cam follower 150 mounted on the outer end of the lower arm 148 of the rocker arm 140. This cam follower 150 is selectively engageable with a pair of cams 154, 156 (FIG. 5) mounted upon and non-rotatably keyed to a cycle control shaft 158 of the coiler. A pneumatic cylinder 160 determines which of the two cams 154, 156 is engaged with the follower 150. The cam with which the follower is engaged controls the diameter of the coil generated by either the wire 12 or 14. One cam 154 controls the diameter of the coil produced by the wire 12, and the other cam 156 determines the diameter of the coil produced by the wire 14.

The cams 154, 156 both have an eccentric surface engageable with the cam follower 150. Consequently, in the course of one rotation of the cycle control shaft 158 and the cams 154, 156 keyed thereto, the cam follower 150 is caused to move vertically downwardly and then upwardly relative to the axis of the cam, thereby causing a corresponding vertical movement of the cam follower relative to the axis of the cam. This results in a rocking movement of the rocker arm 140, thereby moving the control block 122 first forward and then rearward relative to the front of the machine. In the course of this movement, the rocker arm is pivoted so as to cause the coil forming tools 30 and 28 to first move away from the wire guide block 46, and then back toward the guide block. Of course, if the cams 154, 156 were circular and not mounted eccentrically relative to the control shaft 158, there would be no resulting movement of the rocker arm 110 or of the coil forming tools 28, 30 relative to the guide block and the resulting coil which would then be formed would be cylindrical in shape rather than barrel-shaped, as is produced with the eccentric cams illustrated in FIG. 1.

Also mounted on the control shaft 116 is a pneumatic cylinder 162. The piston of this cylinder is connected to the control shaft 116 such that actuation of the cylinder affects movement of the control shaft rearwardly, so as to pull the top of the crank arm 110 rearwardly, thereby causing the coil forming tools and the plate upon which they are mounted to be moved to a second position appropriate for formation of the wire 14 into the desired helical configuration by the forming roll 28.

Operation of Coiler

Figure 6:
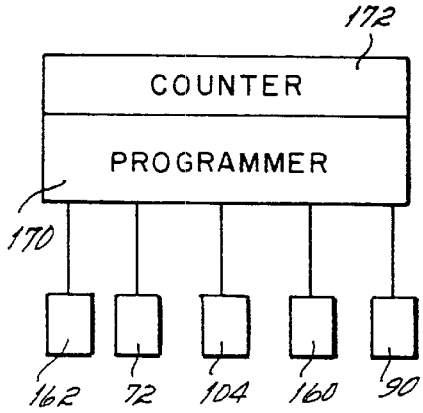
FIG. 6 is a diagrammatic view of the operation programmer.

The operation of the coiler 10 is controlled from a conventional programmer 170 (FIG. 6) which includes a counter 172. This programmer is operative to control actuation of the pneumatic motors 162, 72, 104, 160 and 90 whenever there is a shift from the production of coil springs from one wire 12 to the other 14 or vice versa. That occurs only after the counter has counted an appropriate number of coils having been made from one wire 12, 14 such that production should be shifted to the next wire 12, 14. For example, if ten coil springs 12*c* are to be manufactured from the wire 12 followed by ten wire coil springs 14*c* from the wire 14, the counter will cause the programmer to actuate each of the five pneumatic motors after ten coil springs 12*c* have been produced from one wire 12, and similarly, after ten coil springs have been produced from the other wire 14, the programmer will again cause the pneumatic motors to be actuated so as to shift back to production of coil springs from the other wire.

In the course of production of coil springs on the coiler 10 described hereinabove, one coil spring is produced for each single revolution of the cams 154, 156. The cam shaft 158 upon which these cams 154, 156 are mounted is mechanically linked as, for example, by a conventional timing belt, to the cam shaft 69 of the cam 68 on a one-to-one ratio so that for each revolution of the cams 154, 156, the cam 68 makes one revolution.

As illustrated in FIG. 1, each of the cams 154, 156 and 68 are located in their zero or 12 o'clock position, which is the starting position for the production of a single coil by contact of one of the wires 12, 14 with one of the forming rollers 28, 30. In this example, we will assume that the machine is initially in the position in which the coil former 28 is aligned with the discharge outlet of the wire guide 46 such that the wire 12 will be formed into a helical configuration by that wire former 28 and the pitch control tool 32.

After approximately 15° of rotation of the cam 68, the cam follower 64 is caused to move upwardly, thereby moving the rocker arm 60 about its rocker shaft 62. This has the effect of raising the lower feed roller 22 as a consequence of that roller being lifted by the block 52 within which it is mounted and raised by the pin 56 of the crank arm 60. Simultaneously, an arm 36 of rocker arm 60 is thereby lowered and rotates the bell crank 33 upon which the cutter 34 is mounted. This pivots the cutter 34 in the direction indicated by the arrow 35 to the position in FIG. 2 to a non-interfering position relative to wire 12 being fed from the guide block 46 into engagement with the forming roll 28. As the wire 12 emerges from the guide block 98 into contact with the forming roller 28, it is formed into a helical configuration as a consequence of engagement with the feed roll 28 and the pitch determining tool 32.

While the cam 68 is making one complete revolution and forming several turns of the helically wound coil spring, the cam 154 is also making a single revolution, and in the course of the cam follower 150 associated with that cam 154 following the profile of the cam, the follower is caused to move initially downwardly and then back upwardly to its starting position. In the course of moving downwardly, the cam follower 150 causes the rocker arm 140 to pivot about its rocker shaft 138, thereby moving the control block 122 initially to the right as viewed in FIG. 1, and then back to the left to its starting position at the completion of one fall revolution. This movement of the rocker arm 140 results in a corresponding movement of the rocker arm 110 which has the effect of moving the forming roller and the block 100 upon which it is mounted initially away from the guide block 24 and then back toward the guide block. Thereby, the coil spring which is formed in the wire 12 has turns which are initially of smaller diameter, then larger diameter and back to a smaller diameter, thereby creating a barrel-shaped coil spring 12*c*.

After the cams 68 and 154 have rotated through approximately 345° from their initial starting position, the cam follower 64 engaged with the cam 68 moves the rocker arm 60 downwardly, thereby disengaging the lower drive roll 22 from its clamped engagement with the wire and the opposed roll 20 to thereby briefly terminate the feed of the wire between the rolls. Simultaneously, movement of the cam follower downwardly relative to the cam 68 causes the far end arm 60 of the rocker arm to move upwardly, thereby pivoting the bell crank 33 in a diameter opposite the arrow 35 and into engagement with the stationary wire such that the wire is cut by the leading edge 37 of the cutting tool 34.

When the cams 68 and 154, 156 reach their 12 o'clock or centered starting position after one full revolution, a proximity switch 176 fixedly mounted on the hub of cams 154, 156 is triggered by passing a finger 178 fixedly mounted on the frame, the switch 176 coming in close proximity to that finger 178. That signal is transmitted to the counter 172. In the event that less than the total number of coil springs to be produced from the wire 12 has been produced, the machine is then signaled to continue to produce springs from the wire 12 until the counter has counted an appropriate number of springs to match the preprogrammed count of springs to be produced from that wire. After that number have been produced, the programmer 170 is operative when the cams reach the 12 o'clock or starting position illustrated in FIG. 1 to actuate all of the pneumatic cylinders 162, 72, 90, 160 and 104. This has the effect of moving the upper feed roller 20 axially and repositioning it to a position in which the wire 14 is in a shallow groove of the feed roller 20. As a consequence, when the opposed roller 22 is subsequently raised, the wire 14 will be fed from between the feed rollers into and through the guide block 24, and the wire 12 will remain stationary. Actuation of the pneumatic motor 104 causes the block 100 upon which the forming tools 28 and 30 are mounted to be rotated through approximately 45° of rotation so as to position the feed roller 30 in a position to engage the end of the wire 14 and as the wire 14 is fed from the guide block 24. The motor 90 simultaneously repositions the pitch control or pitch determining tool 32 in the appropriate position for forming the desired helical spring from the wire 14. The cylinder 162 moves the rocker arm 110 to its second position appropriate for forming the wire 14 into the desired helical configuration. And, the cylinder 90 repositions the pitch control tool in the appropriate position for imparting the desired pitch to coil springs formed from the wire 14.

After these cylinders 162, 72, 104, 160 and 90 have been repositioned for causing the forming tool 28 and pitch control tool 32 to create the desired coil spring configuration from the wire 14, the cams 68 and 156 are caused to rotate, thereby again causing the rotating feed roller 22 to move upwardly into pressure engagement of the wire 14 between the continuously rotating feed rolls 20, 22, thereby causing those feed rolls to move the wire 14 through the guide block 24 into engagement with the feed roller 28. Again, in the course of one revolution of each of the cams 68 and 156, a single coil spring 14*c* is formed by the forming roll 30 and pitch control tool 32. During the last approximately 15° of rotation of these cams, the cutter 34 is actuated while the feed roll 22 is disengaged from pressing and feed engagement with the wire, and the wire 14 is cut to complete the formation of a single helical coil spring 14*c*. This procedure is continued and rotation of the cams is controlled for an appropriate number of rotations until the counter 172 has counted the preprogrammed number of springs 14*a* having been formed from the wire 14, after which the pneumatic cylinders are again actuated to cause the cylinders 162, 72, 104, 160 and 90 to move to their first position described hereinabove whereat coil springs are formed from the wire 12.

In many applications of the coiler of this invention, the coil springs 12*c*, 14*c* formed from the two different wires will be of the same overall dimensions, i.e., the same helical configuration and the same length such that they may be placed in a single spring core assembly for manufacture of a mattress. Because, though, the wires 12 and 14 are of differing diameter and consequently, differing stiffness and resistance to formation into a coil spring configuration, the forming tools 28, 30 and 32 require differing positions relative to the wires to effect the same overall configuration of the resulting springs.

It should be appreciated, though, that the springs do not always have to be of the same overall configuration, but that the machine of this invention may be set up so as to create springs of differing configuration from the two different wires 12 and 14.

While we have described only a single preferred embodiment of the invention of this application, persons skilled in this art will appreciate changes and modifications which maybe made without departing from the invention of this application.

We claim:

1. Apparatus for selectively manufacturing mattress and furniture coil springs from two different wires, comprising:

a powered wire feeding device comprising a pair of opposed wire feed rollers, said rollers being continuously rotatable without interruption in one wire feed direction during the manufacture of spring coils from one of said two different wires, during the changeover from one wire to the other, and during the manufacture of coil springs from the other of said two different wires, said wire feeding device having an input side and an output side;

a wire guide disposed adjacent the output side of the powered wire feeding device and adapted to support both of said two different wires; and a coil forming mechanism disposed adjacent the output side of the wire guide, said coil forming mechanism comprising a pair of coil forming tools and at least one coil pitch determining tool, each of said pair of coil forming tools being selectively movable into alignment with one of said two different wires so that one coil forming tool is engageable with and operative to form one wire into a coil and the other coil forming tool is engageable with and operative to form the other wire into a coil.

2. The apparatus of claim 1 wherein each of said pair of coil forming tools is a roller.

3. The apparatus of claim 1 which further includes a wire cut off tool for cutting a formed coil spring from the wire supported on said wire guide after formation of a coil by said coil forming mechanism.

4. The apparatus of claim 3 wherein a cam controls actuation of said wire cut off tool.

5. The apparatus of claim 4 wherein said cam also controls driving engagement and disengagement of said pair of opposed wire feed rollers with said two different wires.

6. The apparatus of claim 1 wherein said two different wires are of differing wire diameter.

7. The apparatus of claim 1 wherein said at least one coil pitch determining tool is a single pitch determining tool movable between two different positions depending upon which of said two different wires is aligned with one of said pair of coil forming rollers.

8. The apparatus of claim 1 which further includes a cam controlled linkage for varying the diameter of coils of a coil spring formed by each of said coil forming tools.

9. The apparatus of claim 8 wherein said cam controlled linkage includes two cams, one of said cams being operative to control the diameter of coils of a coil spring formed by one of said pair of coil forming tools and the other of which is operative to control the diameter of coils of a coil spring formed by the other of said pair of coil forming tools.

10. A method for selectively manufacturing mattress and furniture coil springs from two different wires; comprising:

locating said two wires between opposed wire feed rollers;

continuously rotating said opposed wire feed rollers without interruption in one wire feed direction;

supporting said two wires upon a wire guide positioned adjacent an output side of the wire feed rollers;

positioning a first coil forming tool in alignment with a first one of said two wires supported upon said wire guide;

moving said rotating opposed feed rollers into driving engagement with said first one of said wires so as to feed said first wire into engagement with said first coil forming tool and a pitch determining tool so as to create a helically formed coil spring at the end of said first wire;

moving said rotating opposed feed rollers out of driving engagement with said first wire to terminate feed of said first wire between said feed rollers;

cutting said helically formed coil spring from the end of said first wire;

moving a second forming tool into alignment with a second of said two wires supported upon said wire guide;

moving said rotating opposed feed rollers into driving engagement with said second wire so as to feed said second wire into engagement with said second coil forming tool and a pitch determining tool so as to create a helically formed coil spring at the end of said second wire;

moving said rotating opposed feed rollers out of driving engagement with said second wire to terminate feed of second wire between said opposed feed rollers; and cutting said helically formed coil spring from the end of said second wire.

11. The method of claim 10 which further comprises moving each of said coil forming tools relative to said wire guide during creation of said helically formed coil springs so as to vary the diameter of said coil springs between oppose ends thereof.

12. A method for selectively manufacturing mattress and furniture coil springs from two different wires; comprising:

locating said two wires between a pair of opposed wire feed rollers;

continuously rotating said pair of opposed wire feed rollers without interruption in one wire feed direction;

supporting said two wires upon a wire guide positioned adjacent an output side of the wire feed rollers;

positioning a first coil forming tool in alignment with a first one of said two wires supported upon said wire guide;

moving said rotating pair of opposed feed rollers into engagement with said first one of said wires so as to feed said first wire into engagement with said first coil forming tool and a pitch determining tool so as to create a helically formed coil at the end of said first wire;

moving said pair of rotating opposed feed rollers apart to terminate feed of said first wire between said first roller;

cutting said helically formed coil from he end of said first wire;

moving a second forming tool into alignment with the second of said two wires supported upon said wire guide;

moving said rotating pair of opposed feed rollers into engagement with said second wire so as to feed said second wire into engagement with said second coil forming tool and a pitch determining tool so as to create a helically formed coil at the end of said second wire; and cutting said helically formed coil from the end of said second wire.

13. The method of claim 12 which comprises further moving on of said pair of opposed drive rolls axially relative to the other drive roll after terminating feed of said first wire and before moving said pair of opposed feed rolls into driving engagement with said second wire.

14. A method of selectively manufacturing mattress and furniture coil springs from two different wires on a machine having a powered wire feeding device comprising a pair of opposed wire feed rollers, a wire guide disposed adjacent an output side of the powered wire feeding device, a coil forming mechanism disposed adjacent an output side of the wire guide, which coil forming mechanism comprises a pair of coil forming rollers and at least one coil pitch determining tool, which method comprises:

positioning said two wires on said wire guide and between said pair of opposed wire feed rollers;

aligning one of said forming rolls with one of said wires on said wire guide;

moving said opposed feed rolls into driving engagement with a first one of said two wires so as to feed said first one of said wires into engagement with said one forming roll and said pitch determining tool so as to create a helically formed wire on the end of said first one of said wires;

discontinuing feed of said one of said wires by moving said pair of opposed wire feed rollers out of driving engagement with said first one of said wires while continuing rotation of said opposed wire feed rollers;

cutting said helically formed wire from the end of said first one of said wires;

moving said second of said pair of coil forming rollers into alignment with the second of said two wires positioned on said wire guide;

moving said rotating pair of opposed feed rollers into driving engagement with the second of said two wires to feed said second of said wires into engagement with said second forming roll and said pitch determining tool to create a helically formed wire on the end of said second of said wires; and cutting said helically formed wire from the end of said second wire.

* * * * *